US007076343B2

(12) United States Patent
Kornick et al.

(10) Patent No.: US 7,076,343 B2
(45) Date of Patent: Jul. 11, 2006

(54) PORTABLE COMMUNICATIONS DEVICE INTEGRATING REMOTE CONTROL OF RAIL TRACK SWITCHES AND MOVEMENT OF A LOCOMOTIVE IN A TRAIN YARD

(75) Inventors: David Kornick, Melbourne, FL (US); Robert James Foy, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 10/759,319

(22) Filed: Jan. 16, 2004

(65) Prior Publication Data

US 2004/0167687 A1 Aug. 26, 2004

Related U.S. Application Data

(60) Provisional application No. 60/448,701, filed on Feb. 20, 2003, provisional application No. 60/528,862, filed on Dec. 11, 2003.

(51) Int. Cl.
*B60T 3/00* (2006.01)
*G06G 1/00* (2006.01)

(52) U.S. Cl. ..... 701/19; 701/117; 246/27

(58) Field of Classification Search ..... 701/19, 701/117; 700/33; 246/182 C, 4, 27, 2 R, 246/473.2, 5, 122 R
See application file for complete search history.

(56) References Cited

U.S. PATENT DOCUMENTS 2,951,452 A 9/1960 Karlet
4,023,753 A * 5/1977 Dobler ..... 246/5
4,122,523 A * 10/1978 Morse et al. ..... 701/117
5,437,422 A 8/1995 Newman
5,487,516 A * 1/1996 Murata et al. ..... 246/182 C
5,685,507 A 11/1997 Horst et al.

(Continued)

FOREIGN PATENT DOCUMENTS

DE 19743306 A1 4/1999

(Continued)

OTHER PUBLICATIONS

Joe Denny, et al., *Communications-Based Yard Control (CB:YC<TM>) System*, Proceedings of the 2000 ASME/IEEE Joint Railroad Conference, Newark, NJ, Apr. 4-6, 2000, Proceedings of the ASME/IEEE Joint Railroad Conference, New York, NY: IEEE, US, Apr. 4, 2000, pp. 95-110, XPO10512397.

*Primary Examiner*—Dalena Tran
(74) *Attorney, Agent, or Firm*—Enrique J. Mora; Beusse, Wolter, Sanks, Mora & Maire, P.A.

(57) ABSTRACT

A communications device is provided for controlling operation of an unmanned locomotive over a track layout in a train yard. The locomotive is operable over a plurality of alternative track routes to reach a respective destination from a plurality of possible destinations in said track layout. The track layout includes a plurality of switches configured to alter a route for a locomotive running along the track layout. The communications device may include a first user display for use in commanding a desired destination for the locomotive within the track layout by setting the state of the switches along the route to the destination. The communications device may further include a second user display for use in controlling movement of the locomotive along the track layout.

9 Claims, 2 Drawing Sheets

U.S. PATENT DOCUMENTS 5,751,569 A 5/1998 Metel et al.
5,758,848 A 6/1998 Beule
5,775,647 A 7/1998 Wyatt
5,896,017 A * 4/1999 Severson et al. ..... 312/280
6,135,396 A 10/2000 Whitfield et al.
6,246,956 B1 6/2001 Miyoshi et al.
6,314,345 B1 11/2001 Coombes
6,445,150 B1 9/2002 Tanner et al.
2004/0030538 A1* 2/2004 Hawthorne et al. ..... 703/8

FOREIGN PATENT DOCUMENTS

DE 19840715 C1 11/2000
DE 10117387 A1 10/2002
WO WO 95/10439 4/1995

* cited by examiner

PORTABLE COMMUNICATIONS DEVICE INTEGRATING REMOTE CONTROL OF RAIL TRACK SWITCHES AND MOVEMENT OF A LOCOMOTIVE IN A TRAIN YARD

This application claims priority to a provisional application filed on Feb. 20, 2003, having application No. 60/448,701, and to a provisional application filed on Dec. 11, 2003, having application Ser. No. 60/528,862, which are both incorporated herein by reference.

FIELD OF THE INVENTION

The present invention is generally related to railroad communication devices, and, more particularly, to a portable communications device integrating a user display for remote control of rail track switches at a train yard and a user display for remote control of the movement of a locomotive within the train yard.

BACKGROUND OF THE INVENTION

Known train routing techniques at a train yard require access to and the use of separate communication devices, and further require time consuming and burdensome coordination among various personnel to ensure that an appropriate selection and activation of rail track switches is accurately performed to achieve a desired transfer or routing of a locomotive from a given location to a desired destination within the train yard.

In one known technique, the operator at the train yard may request actuation of each individual rail track switch along a route of movement of the locomotive via a handheld voice radio using a set of DTMF tones unique to each switch. Preferably, the same operator also controls movement of a remote controlled locomotive (RCL) with a separate device, e.g., an operator control unit (OCU) for such a locomotive. The fact that the operator simultaneously needs to physically handle two separate devices may result in sub-optimal operations from an ergonomics point of view. In addition, requesting activation of an individual switch at a time may be rather cumbersome considering that in a typical train yard to reach a desired destination may involve activating a switching combination comprising a plurality of switches. In large railyards, there are numerous tracks, switches, possible routes and switch combinations. In the known techniques, the operator must identify the appropriate switches for the desired route, interact via a cell phone with each of these switches on an individual basis, confirm that each switch has moved to the desired state or switching position, and move the train via the OCU in increments between adjacent switches. Moreover, because of other traffic in the railyard, certain switches along a chosen route may not be available for use. Partial, and thus incomplete movement of one locomotive may in turn interfere with the orderly movement of other locomotives in the yard. Also user displays in known portable train routing devices for train yard operations are usually limited to alphanumeric characters, and thus may not fully achieve the simplicity of operation and user friendliness that would be desirable.

In view of the foregoing considerations, it would be desirable to integrate in a single portable communications device functionality for achieving remote control of movement of the locomotive, and automated functionality for the appropriate selection and activation of the rail track switches. It would be further desirable to provide a single portable communications device allowing the operator to directly or indirectly input a switching combination that may comprise a plurality of switches for reaching the desired destination. It would also be desirable to provide a graphical user interface in such a portable communications device. Further it would be desirable to confirm that the switches of switches necessary for a selected route are available for use and to confirm that these switches have been set in the necessary positions for the route before moving the locomotive.

BRIEF DESCRIPTION OF THE DRAWINGS

The advantages of the invention will be more apparent from the following detailed description in view of the following drawings.

DETAILED DESCRIPTION OF THE INVENTION

Figure 1:
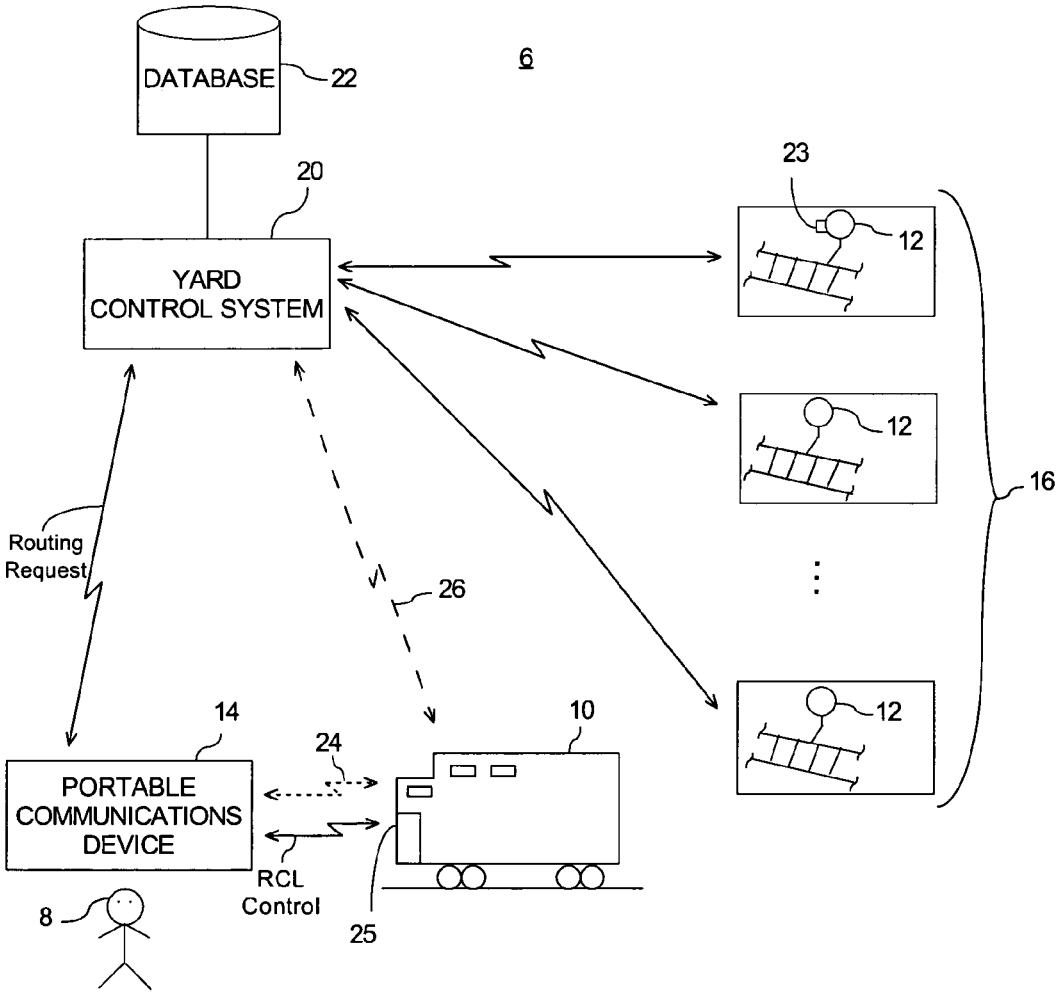
FIG. 1 is a schematic representation of an exemplary command communication and control (CCC) train rail yard system embodying aspects of the present invention.

As illustrated in the schematic representation of FIG. 1, a command communication and control (CCC) train rail yard system 6 embodying aspects of the present invention provides to an operator 8 of a Remote Controlled Locomotive (RCL) 10 the ability to actuate combinations of one or more remote controlled track switches 12 via a portable communications device 14, such as an Operator Control Unit (OCU) that may be hand-held or otherwise supportable by the body of the operator. Portable communications device 14 also allows the operator to control movement of the locomotive 10. This provides operator 8 with the ability to command a switching strategy for routing the locomotive and also guiding the locomotive from any given track to any other track in a rail track layout 16 of the train yard.

As will be appreciated by those skilled in the art, a train yard may comprise a large number of inter-connectable rail tracks, which are connectable through the actuation of appropriate combinations of switches (e.g., switches 12) to a suitable switching state. In a typical train yard operation, routing a locomotive from one track to another track may require setting to the appropriate switching state a plurality of switches.

Figure 2:
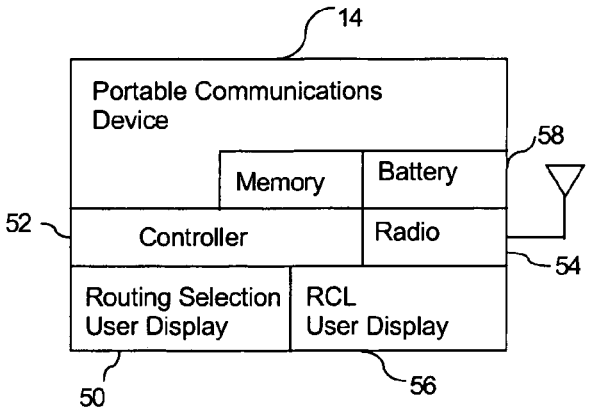
FIG. 2 is a block diagram of an exemplary embodiment of a portable communications device, as may be part of the train rail yard system of FIG. 1, configured to integrate a first user display for selecting a desired route within a train yard, and a second user display for controlling movement of the locomotive.

In one exemplary embodiment portable communications device 14 (FIG. 2) comprises a first user display or user interface 50 for selecting a desired route. This may allow communicating a routing request message, such as requesting a transfer from a given entrance gate to a desired exit gate. In one exemplary embodiment, the communications device 14 comprises a controller 52, such as a dedicated micro-controller, a Field Programmable Gate Array (FPGA) device, or Application Specific Integrated Circuit (ASIC) device, coupled to a radio device 54 and responsive to first user interface 50 to communicate command routing information to a yard control system 20 (FIG. 1) by way of a radio message that carries data indicative of the desired routing or transfer for the locomotive. By way of example and not of limitation one yard control system that may be suitable for implementing aspects of the present invention may be the system referred in commerce as Proyard NX yard control system.

Portable communications device 14 further comprises a second user display or user interface 56 for controlling movement of the locomotive, such as propulsion power, braking action, speed control, and other functionality useful in a moving locomotive, such as horn actuation, light control, etc. A battery 58 or other suitable power source may be used for electrically powering the various electronic modules that make up the portable communications device 14.

A database 22 (FIG. 1), as may be coupled to the yard control system 20, comprises data files and program code that allows generating switching commands for activating to an appropriate switching position a switch (or combination of switches) required for reaching the desired routing specified by operator 8 via the portable communications device 14. For example, the message for routing the locomotive from the given entrance gate to the desired exit gate may require activation of a given combination of switches to a respective switching state. Instead of yard personnel determining which particular combination of switches shall be activated, the database would be programmed to automatically make the appropriate switching selection in response to the message requesting the desired routing.

In the event, any of the tracks needed for implementing the transfer is not available, one or more alternative switching routes would be implemented for reaching the desired track. For example, routing the locomotive from the given entrance gate to the desired exit gate may normally require passing through a particular track. However, in the event another locomotive is already using that particular track, the database would select an alternative switching combination that avoids going through that particular track. Once each of the switches in the switching combination is set to the appropriate switching position, a confirmation or verification message may be sent to the operator to acknowledge execution of the switching strategy for routing the locomotive from the given entrance gate to the desired exit gate, for example.

Aspects of the present invention are expected to lead to greater reliability and productivity regarding train yard operations since, for example, a single operator would be able to remotely control movement of the locomotive and command a routing strategy from a single communications device and no additional personnel would be needed as intermediaries for figuring out which switching combination needs to be performed to reach a desired track. This would further allow the operator of the RCL to focus his attention on safely controlling the locomotive as opposed to having to deal with the burdensome logistics of manually trying to figure out the specific switching combination that needs to be performed or having to coordinate with other personnel to make the specific switching combination.

In one exemplary embodiment, once the appropriate switch combination is set, a suitable transducer 23 (FIG. 1 illustrates one such transducer) in each switch may be responsive to a corresponding switch state and may be configured to transmit a status message back to the yard control system and in turn to operator 8 via the portable communications device 14. Thus, the operator will be informed essentially in real time whether the original transmitted command for performing a given switch combination was executed.

In another exemplary embodiment, once the operator selects a desired routing, the routing command as represented by dashed line 24 may be optionally sent from the portable communications device 14 to the locomotive 10 in lieu of being sent to the yard control system. In this case, onboard communication equipment 25 will receive the routing command and in turn transmit that routing command via a suitable onboard radio coupled to the yard control system, as represented by dashed line 26. Similarly, a message with verification of execution of the routing command may be sent back to the operator via the radio onboard the locomotive.

Figure 3:
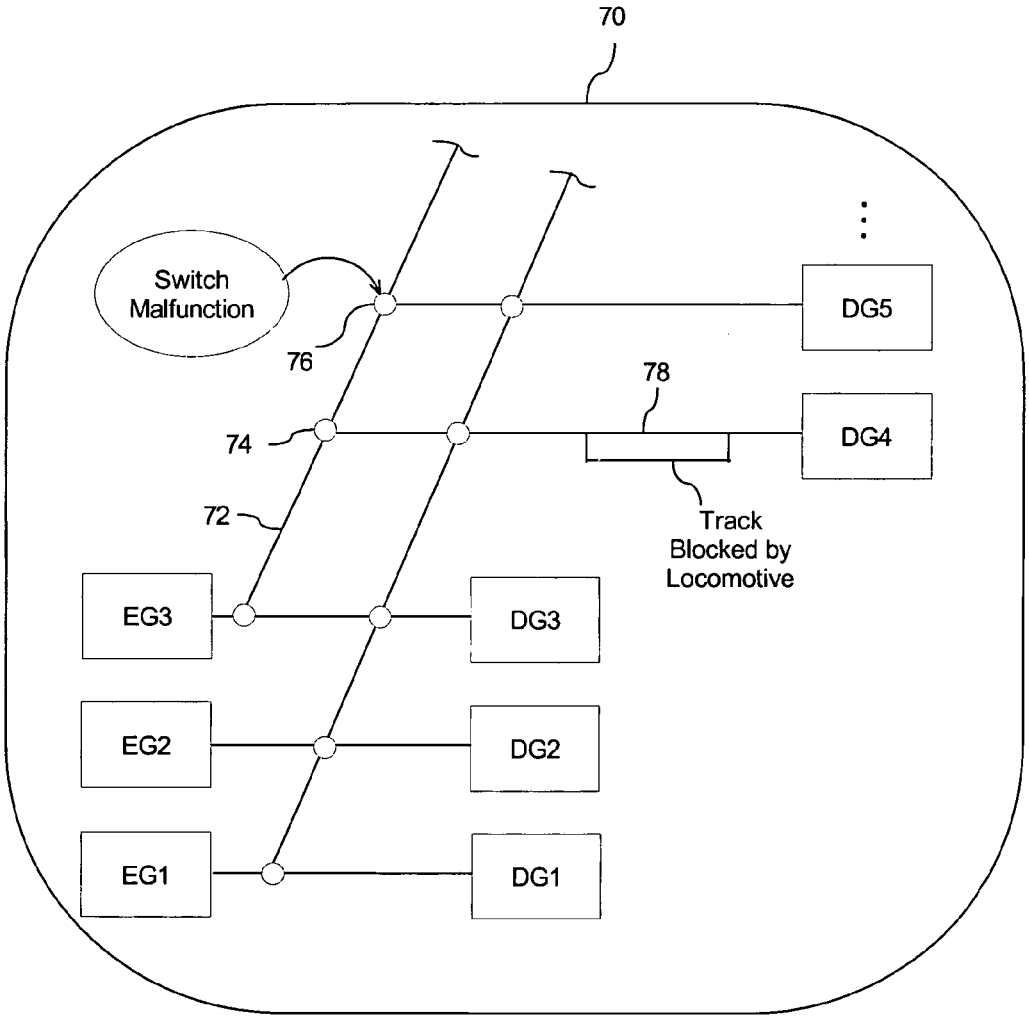
FIG. 3 is an exemplary representation of graphical user interface as may be used for displaying information to an operator in connection with a route status within the train yard.

FIG. 3 is an exemplary representation of graphical user interface (GUI) 70 as may be used for displaying information to an operator in connection with a route status within the train yard. For example, the graphical user interface may graphically display a map of a plurality of entrance gates, (designated EG1–EG3), and a plurality of destination gates (designated DG1–DG5) and including possible rail tracks 72 and 78 and switching nodes 74 and 76 for interconnecting such gates. Various types of information may be displayed on the GUI, such as whether there is a malfunction at a switching node 76, or whether a track 78 is presently blocked by another locomotive.

For smaller railyards having fewer tracks, switches and potential routes for the locomotives, the database 22 may be stored on the OCU or a locomotive control unit for example on a so-called switcher locomotive, with the communications with the switches being accomplished via the OCU or the locomotive control unit.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A communications device to be carried by an operator for controlling operation of an unmanned locomotive over a track layout in a train yard, said locomotive operable over a plurality of alternative track routes to reach a respective destination from a plurality of possible destinations in said track layout, said track layout including a plurality of switches configured to alter a route for a locomotive running along said track layout, said communications device comprising:

a first user display for use by said operator in commanding a desired destination for the locomotive within said track layout by setting the state of the switches along the route to the destination; and a second user display for use by said operator in controlling movement of the locomotive along said track layout, wherein the combination of said first and second user displays in said communications device allows respective command and control operations to be performed by said operator with respect to the unmanned locomotive for performing train yard activities.

2. The device of claim 1 wherein the displays are made on a single display device having first and second modes of operation.

3. The device of claim 1 wherein the displays are made on two display devices, one for each display.

4. The device of claim 1 wherein the second display is made on a graphic user interface enabling data input from the operator.

5. The system of claim 1 wherein the commanded desired destination from the communications device is transmitted to the train yard control system via communications equipment onboard the locomotive.

6. A communications device to be carried by an operator for controlling operation of an unmanned locomotive over a track layout in a train yard, said locomotive operable over a plurality of alternative track routes to reach a respective destination from a plurality of possible destinations in said track layout, said track layout including a plurality of switches configured to alter a route for a locomotive running along said track layout, said communications device comprising:

a user display enabling said operator to command a desired destination for the locomotive within said track layout by said operator setting the state of the switches along the route to the destination without intervention from other personnel.

7. A communications device to be carried by an operator for controlling operation of an unmanned locomotive over a track layout in a train yard, said locomotive operable over a plurality of alterative track routes to reach a respective destination from a plurality of possible destinations in said track layout, said track layout including a plurality of switches configured to alter a route for a locomotive running along said track layout, said communications device comprising:

a graphical user interface for use by said operator for commanding a desired destination for said locomotive within said track layout, said graphical user interface configured to display to said operator a representation of said track layout, and wherein said representation allows said operator to monitor operational conditions of the switches that may develop along the route of the locomotive.

8. A communications device to be carried by an operator for controlling operation of an unmanned locomotive over a track layout in a train yard, said locomotive operable over a plurality of alternative track routes to reach a respective destination from a plurality of possible destinations in said track layout, said track layout including a plurality of switches configured to alter a path for a locomotive running along said track layout, said communications device comprising:

a user display to be used by said operator for commanding a desired destination for the locomotive within said track layout, said user display responsive to a verification message indicative of whether a switching combination for the locomotive route for reaching the desired destination has been executed.

9. The system of claim 8 wherein the verification mesage is transmitted to the communications device via communications equipment onboard the locomotive.

* * * * *